US006571439B1

(12) United States Patent
Sens

(10) Patent No.: US 6,571,439 B1
(45) Date of Patent: Jun. 3, 2003

(54) CINERARY URN DEVICE

(76) Inventor: Sheila L. Sens, 20432-88 A Avenue, Langley BC (CA), V1M 1A1

( * ) Notice: Subject to any disclaimer, the term of this patent is extended or adjusted under 35 U.S.C. 154(b) by 0 days.

(21) Appl. No.: 09/865,358

(22) Filed: May 25, 2001

(51) Int. Cl.[7] ..... A61G 17/00
(52) U.S. Cl. ..... 27/1
(58) Field of Search ..... 27/1; D99/5; 248/146; 428/913.3; 40/124.5, 631; 52/103, 104

(56) References Cited

U.S. PATENT DOCUMENTS

| | | | | | |
|---|---|---|---|---|---|
| 7,974 | A | * | 3/1851 | Jenkins | 40/124.5 |
| 215,457 | A | * | 5/1879 | Jackson | 52/103 |
| 463,500 | A | * | 11/1891 | Follenius | 40/124.5 |
| 682,950 | A | * | 9/1901 | McNeal | 40/124.5 |
| 754,269 | A | * | 3/1904 | Witt et al. | 40/124.5 |
| 766,838 | A | * | 8/1904 | Neal | 40/124.5 |
| 822,106 | A | * | 5/1906 | Fancher | 40/124.5 |
| 1,759,398 | A | * | 5/1930 | Hart | 211/14 |
| 2,007,472 | A | * | 7/1935 | Lytle | 40/611 |
| 2,235,617 | A | * | 3/1941 | Klinzing | 220/288 |
| 2,385,520 | A | * | 9/1945 | Klinzing | 27/1 |
| 3,650,072 | A | * | 3/1972 | Matvey | 52/102 |
| 4,344,645 | A | * | 8/1982 | Kirk | 285/61 |
| D266,619 | S | | 10/1982 | Krech | |
| D266,620 | S | | 10/1982 | Krech | |
| 4,442,991 | A | * | 4/1984 | Levens | 248/146 |
| 4,550,537 | A | * | 11/1985 | Smith | 52/103 |
| 5,172,457 | A | * | 12/1992 | Allen et al. | 27/1 |
| D334,642 | S | * | 4/1993 | Allen | D99/5 |
| D341,466 | S | * | 11/1993 | Allen | D99/5 |
| D341,467 | S | * | 11/1993 | Allen | D99/5 |
| D345,848 | S | | 4/1994 | May et al. | |
| D356,422 | S | | 3/1995 | Parker | |
| 5,395,086 | A | * | 3/1995 | Goldstein | 248/346.5 |
| D385,081 | S | | 10/1997 | Parker | |
| 5,704,103 | A | * | 1/1998 | Crowley et al. | 27/1 |
| 5,875,528 | A | | 3/1999 | Parker | |
| 6,088,973 | A | * | 7/2000 | Weiss | 52/105 |
| 6,105,288 | A | * | 8/2000 | Becker | 40/124.5 |
| D440,735 | S | * | 4/2001 | Robinson | D99/28 |
| 6,295,705 | B1 | * | 10/2001 | Gersten | 27/1 |

* cited by examiner

*Primary Examiner*—William Miller

(57) ABSTRACT

A cinerary urn device for holding and displaying cremated remains of a loved one. The cinerary urn device includes a housing for receiving cremated remains. The housing includes at least a front side, a back side, and a bottom side. The bottom side may include an opening that is in communication with an interior of the housing. A cover may be provided for selectively closing the opening in the housing. An exterior of the cover may threadedly engage the bottom side of the housing.

1 Claim, 5 Drawing Sheets

CINERARY URN DEVICE

BACKGROUND OF THE INVENTION

1. Field of the Invention

The present invention relates to urns and more particularly pertains to a new cinerary urn device for holding and displaying cremated remains of a loved one.

2. Description of the Prior Art

The use of urns is known in the prior art. More specifically, urns heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,875,528; U.S. Pat. No. Des. 266,619; U.S. Pat. No. Des. 356,422; U.S. Pat. No. Des. 385,081; U.S. Pat. No. Des. 345,848; and U.S. Pat. No. Des. 266,620.

While these devices fulfill their respective, particular objectives and requirements, the aforementioned patents do not disclose a new cinerary urn device. The inventive device includes a housing for receiving cremated remains. The housing includes at least a front side, a back side, and a bottom side. The bottom side may include an opening that is in communication with an interior of the housing. A cover may be provided for selectively closing the opening in the housing. An exterior of the cover may threadedly engage the bottom side of the housing.

In these respects, the cinerary urn device according to the present invention substantially departs from the conventional concepts and designs of the prior art, and in so doing provides an apparatus primarily developed for the purpose of holding and displaying cremated remains of a loved one.

SUMMARY OF THE INVENTION

In view of the foregoing disadvantages inherent in the known types of urns now present in the prior art, the present invention provides a new cinerary urn device construction wherein the same can be utilized for holding and displaying cremated remains of a loved one.

The general purpose of the present invention, which will be described subsequently in greater detail, is to provide a new cinerary urn device apparatus and method which has many of the advantages of the urns mentioned heretofore and many novel features that result in a new cinerary urn device which is not anticipated, rendered obvious, suggested, or even implied by any of the prior art urns, either alone or in any combination thereof.

To attain this, the present invention generally comprises a housing for receiving cremated remains. The housing includes at least a front side, a back side, and a bottom side. The bottom side may include an opening that is in communication with an interior of the housing. A cover may be provided for selectively closing the opening in the housing. An exterior of the cover may threadedly engage the bottom side of the housing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new cinerary urn device apparatus and method which has many of the advantages of the urns mentioned heretofore and many novel features that result in a new cinerary urn device which is not anticipated, rendered obvious, suggested, or even implied by any of the prior art urns, either alone or in any combination thereof.

It is another object of the present invention to provide a new cinerary urn device which may be easily and efficiently manufactured and marketed.

It is a further object of the present invention to provide a new cinerary urn device which is of a durable and reliable construction.

An even further object of the present invention is to provide a new cinerary urn device which is susceptible of a low cost of manufacture with regard to both materials and labor, and which accordingly is then susceptible of low prices of sale to the consuming public, thereby making such cinerary urn device economically available to the buying public.

Still yet another object of the present invention is to provide a new cinerary urn device which provides in the apparatuses and methods of the prior art some of the advantages thereof, while simultaneously overcoming some of the disadvantages normally associated therewith.

Still another object of the present invention is to provide a new cinerary urn device for holding and displaying cremated remains of a loved one.

Yet another object of the present invention is to provide a new cinerary urn device which includes a housing for receiving cremated remains. The housing includes at least a front side, a back side, and a bottom side. The bottom side may include an opening that is in communication with an interior of the housing. A cover may be provided for selectively closing the opening in the housing. An exterior of the cover may threadedly engage the bottom side of the housing.

Still yet another object of the present invention is to provide a new cinerary urn device that provides closure to people who have lost a loved one. It allows those that are left behind to capture the spirit, character and essence of the loved one who has departed.

Even still another object of the present invention is to provide a new cinerary urn device that provides a means of remembering a lost loved one by providing a means of keeping them at home and close to the heart.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
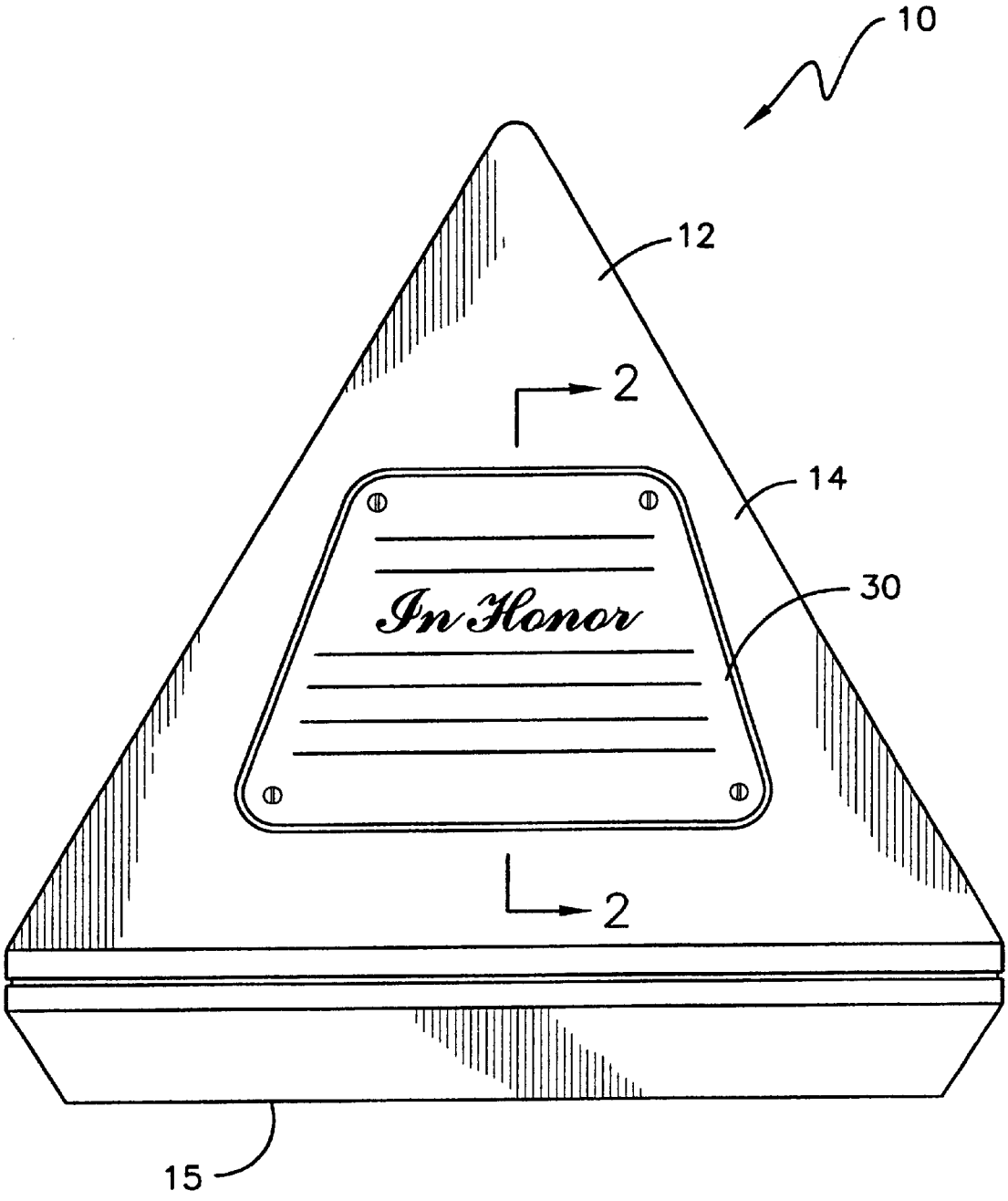
FIG. 1 is a schematic back view of a new cinerary urn device according to the present invention.
Figure 2:
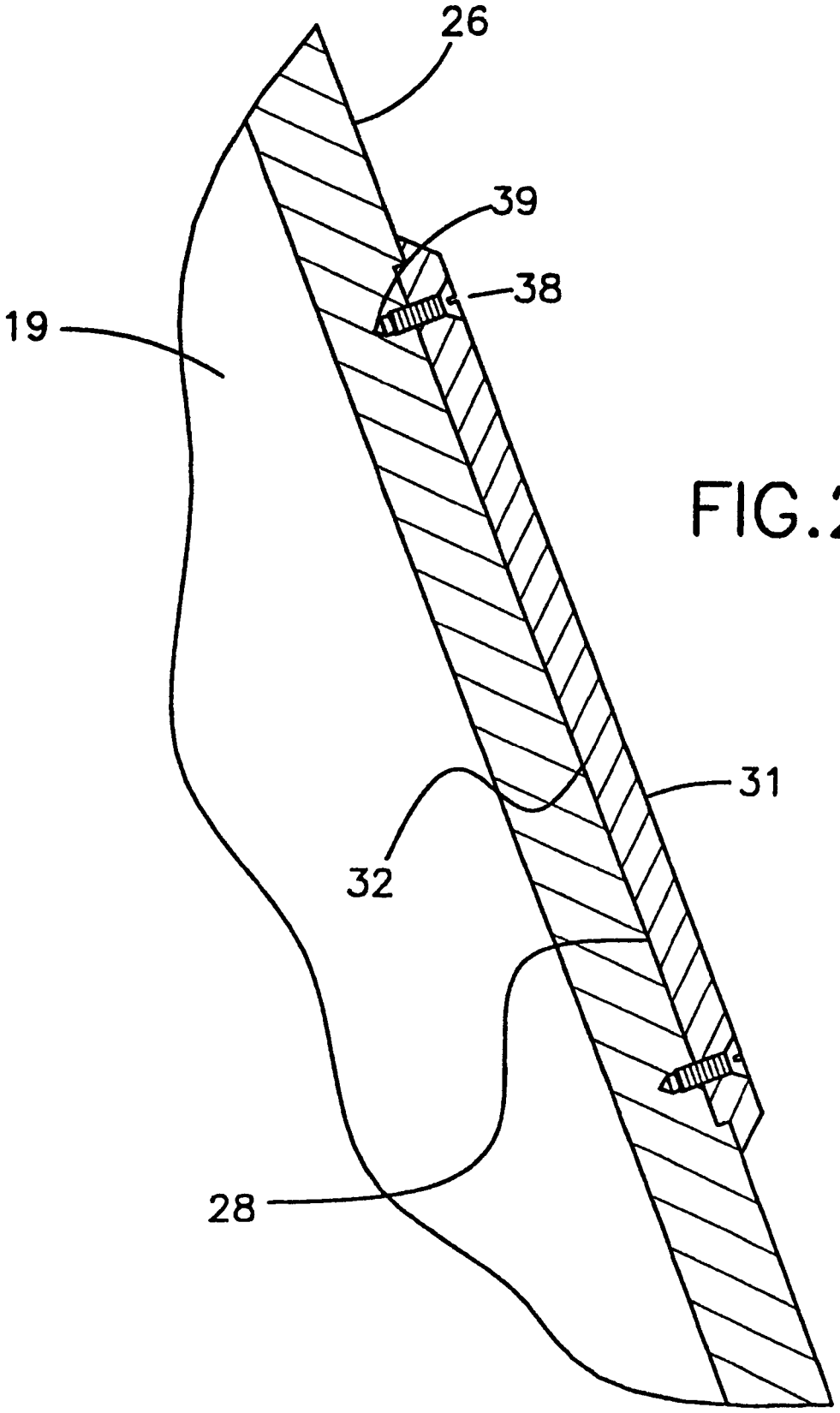
FIG. 2 is a schematic cross-sectional view of the present invention taken along line 2—2 of FIG. 1.

With reference now to the drawings, and in particular to FIGS. 1 through 5 thereof, a new cinerary urn device embodying the principles and concepts of the present invention and generally designated by the reference numeral 10 will be described.

Figure 3:
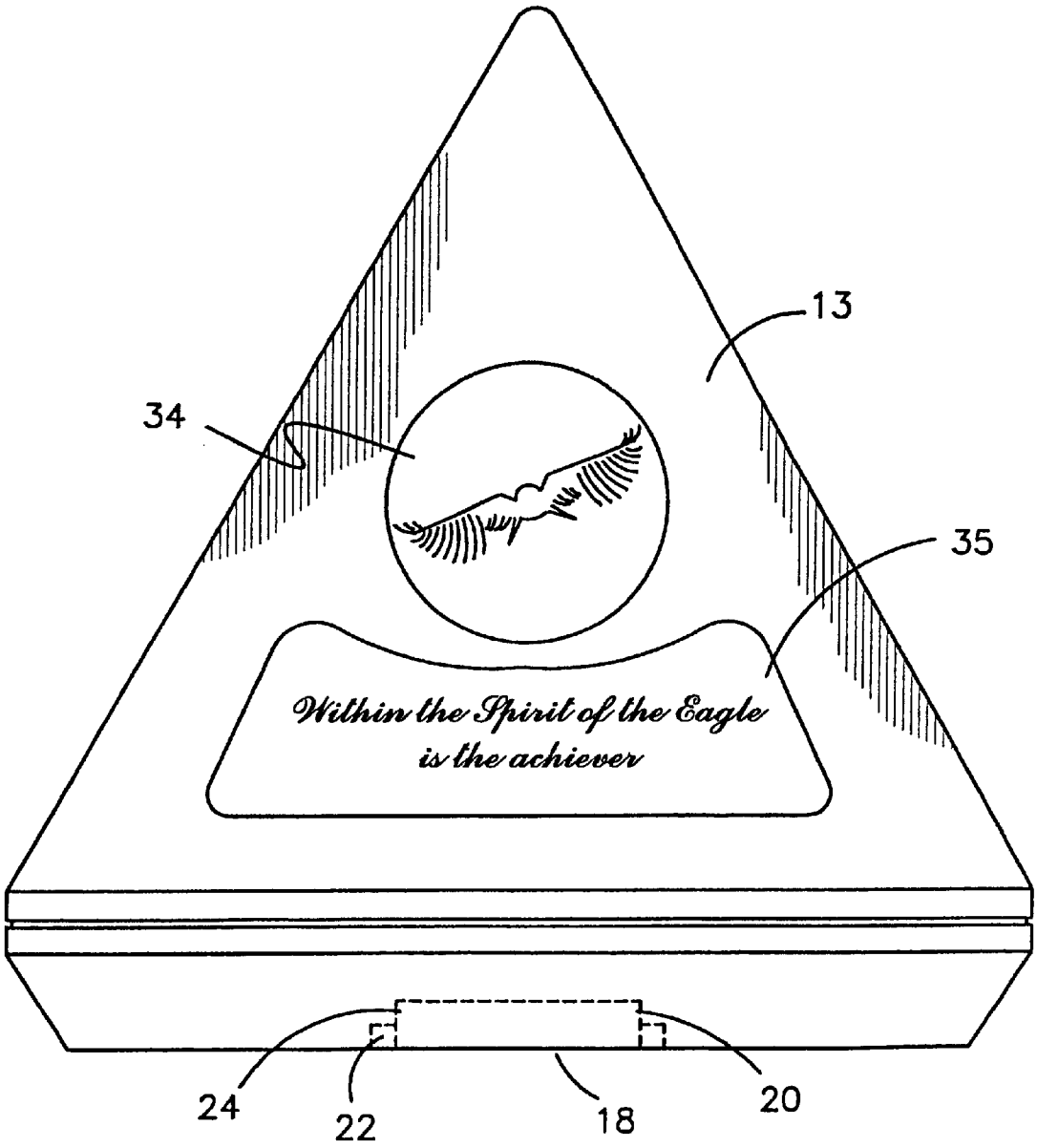
FIG. 3 is a schematic frontal view of the present invention.
Figure 4:
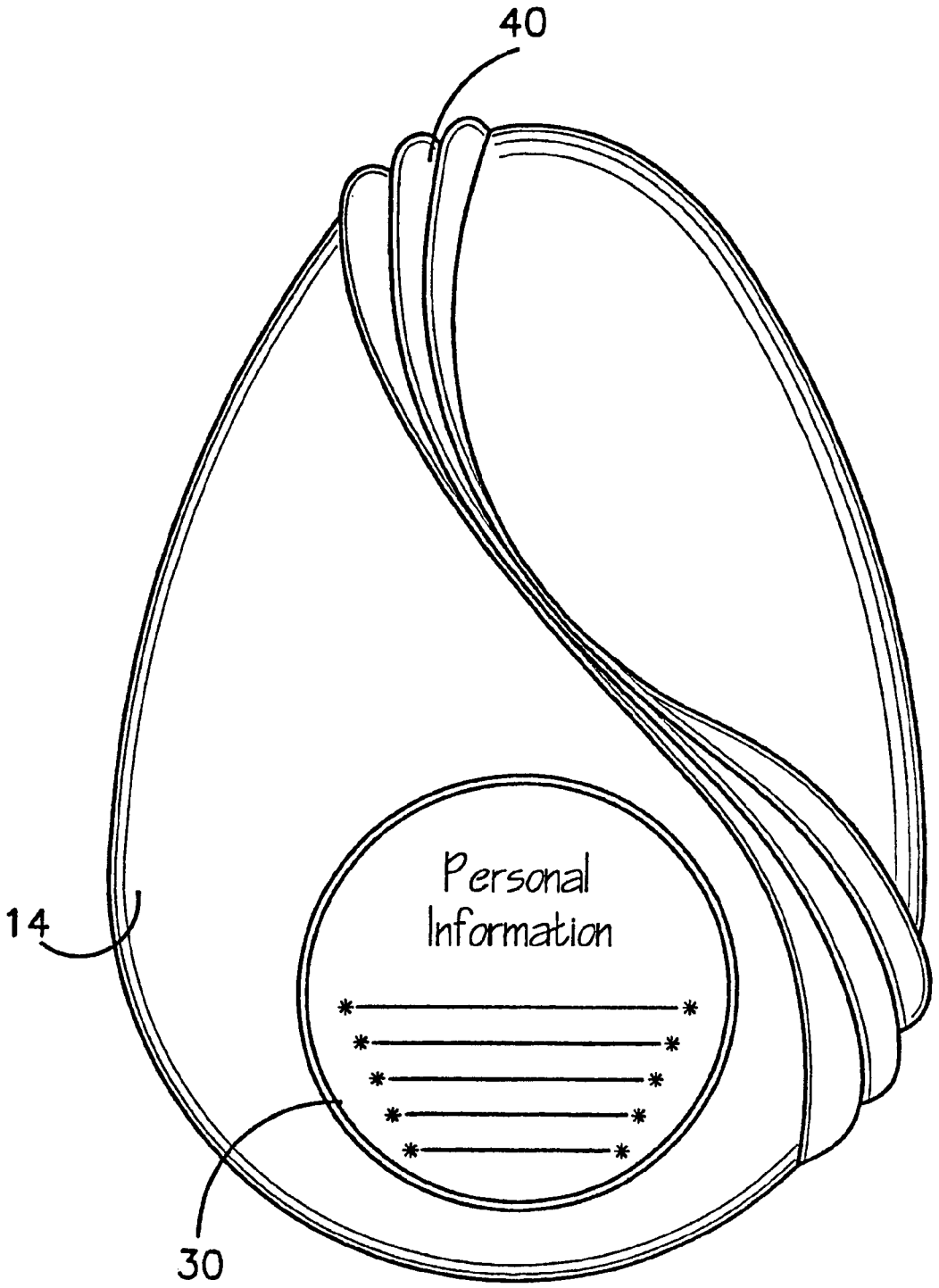
FIG. 4 is a schematic back view of an alternate embodiment of the present invention.
Figure 5:
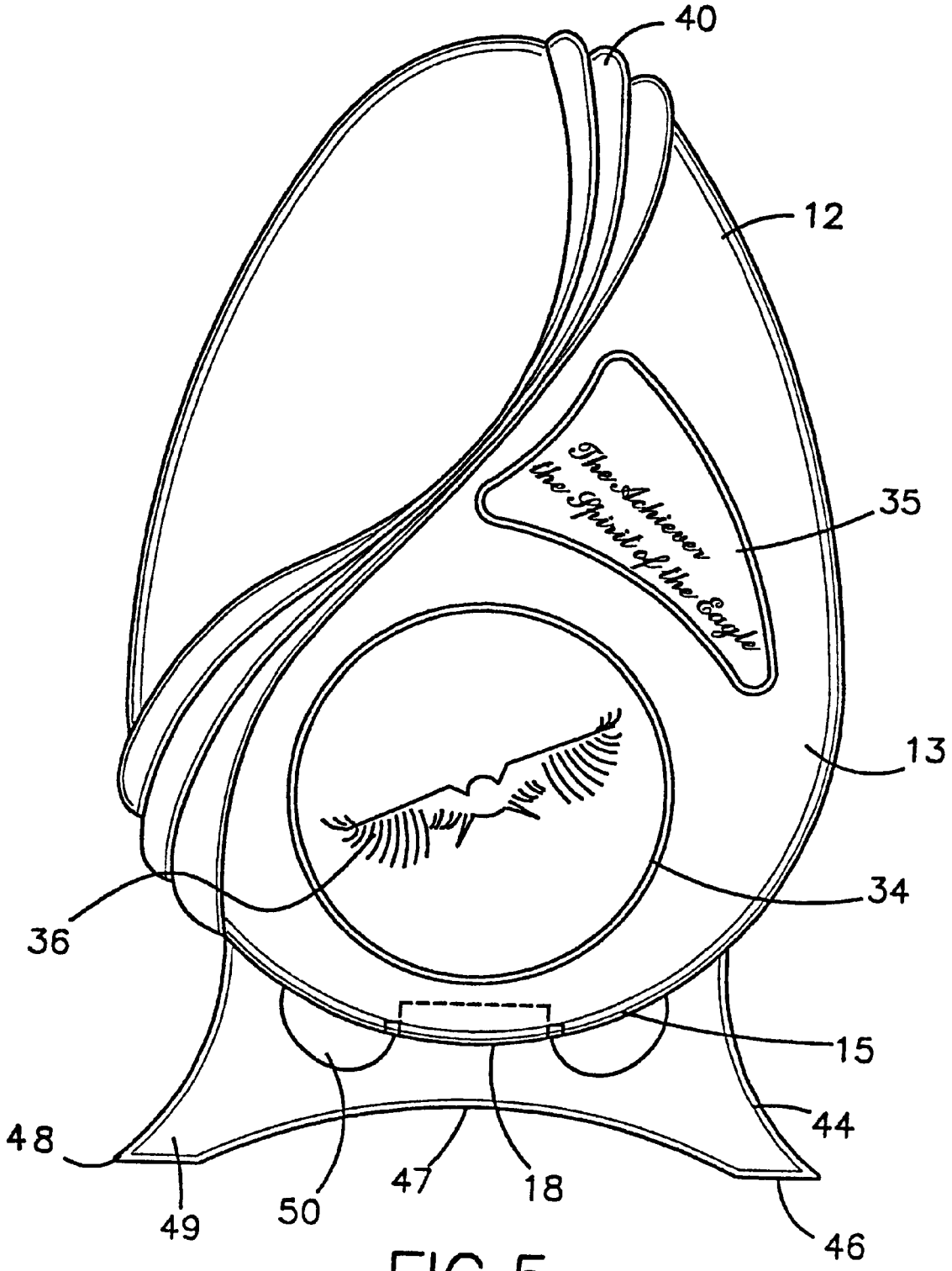
FIG. 5 is a schematic frontal view of alternate embodiment of the present invention.

As best illustrated in FIGS. 1 through 5, the cinerary urn device 10 generally comprises a housing 12 for receiving the cremated remains of a loved on or a pet. In one embodiment of the present invention, as particularly illustrated in FIG. 1, the housing 12 may include front side 13, a back side 14 and a bottom side 15. In one embodiment of the present invention as illustrated in FIGS. 1 and 3, the housing 12 resembles a pyramid. In another embodiment of the present, as illustrated in FIGS. 4 and 5, the housing 12 has an exterior configuration resembling an egg. In both embodiments of the present invention, the bottom side 15 of the housing 12 includes an opening 18 in communication with an interior 19 of the housing 12. The housing 12 may comprise a substantially rigid material such as, aluminum, silver, gold, or titanium.

A cover 20 is provided for selectively closing the opening 18 in the housing 12. The cover 20 may include a bottom wall 22 and a perimeter wall 24 extending away from the bottom wall 22. An exterior of the perimeter wall 24 may threadedly engage the bottom side 15 of the housing 12 for securing the cremated remains in the interior 19 of the housing 12.

An outer surface 26 of the housing 12 may include at least one recess 28 extending therein. At least one plate 30 may be provided and mounted on the housing 12 for displaying indicia. The plate 30 preferably includes an upper surface 31 and a lower surface 32. The plate 30 may be removably mounted in the recesses 28 extending in the housing 12. The plate 30 may be mounted on the back side 14 of the housing 12 and may have a generally trapezoidal shape, however, other shapes may be employed.

As illustrated in FIGS. 3 and 5, a second 34 and third 35 plate may be removably mounted on the front side 13 of the housing 12. The second plate 34 may have a generally circular shape and the third plate may have a generally rectangular or arrow shape, however, other shapes may be employed. The second 34 and third 35 plates are preferably mounted generally adjacent to each other.

Indicia 36 is marked on the upper surface 31 of each of the plates 30, 34 and 35. In one embodiment of the present invention, the indicia 36 marked on the first plate 30 identifies the cremated remains in the housing 12. The indicia 36 marked on the second plate 34 may have a shape resembling an animal, such as, for example, a cat, dolphin, eagle, dove, wolf or swan. The animal indicia 36 may be selected for representing a personality of the loved one contained in cinerary urn device 10.

The indicia 36 marked on the third plate 35 may comprise a saying such as, for example, a verse, eulogy or any other saying that represents the loved one contained in the cinerary urn device A plurality of fastening members 38 may be provided for removably fastening any of the plates 30, 34 and 35 on the housing 12. An end 39 of each of the fastening members 38 preferably extends through the plate 30, 34 or 35 and is removably mounted in the housing 12. Each of the fastening members 38 may comprise a screw.

A decorative member 40 may be mounted on the outer surface 26 of the housing 12. The decorative member 40 may include an exterior configuration resembling a drape that has a plurality of folds with a thickness of each of the folds tapering from a top and bottom sides of the housing 12 toward a center of the housing 12. The decorative member 40 may extend generally about the housing 12. Other decorative members 40 may be employed such as, for example, flowers or religious symbols.

A stand 44 may be provided for supporting the housing 12 above a surface. The stand 44 may include a plurality of spaced leg portions 46 that are coupled together at a central point 47 of the stand 44 such that each of the leg portions 46 radiates outwardly from the central point 47. A width of each of the leg portions 46 may taper from an end 48 of each of the leg portions 46 toward the central point 47. Additionally, a side surface 49 of each of the leg portions 46 may include a hole 50 extending therethrough. Each of the holes 50 may be positioned generally adjacent to the central point 47 of the stand. In one embodiment of the present invention, the cover 20 threadedly coupled to the bottom side 15 of the housing 12 selectively rests on the central point 47 of the stand 44.

In use, a cinerary urn device 10 is selected depending upon the recently departed loved one's personality. Once the cinerary urn device 10 is selected one or more plates 30, 34, and 35 may be removably mounted on the housing 12 to more accurately reflect the loved one.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cinerary urn device for holding and displaying cremated remains, said device comprising:

a housing for receiving the cremated remains, said housing having a front side, a back side, a bottom side and a top side, said housing having a shape resembling a pyramid, said bottom side having an opening in communication with an interior of said housing, an outer surface of said housing having a plurality of recesses extending therein;

a cover for selectively closing said opening in said housing, said cover having a bottom wall and a perimeter wall extending away from said bottom wall, an exterior of said perimeter wall threadedly engaging said bottom side of said housing;

a plurality of plates being mounted on said housing for displaying indicia, each of said plates having an upper surface and a lower surface, each of said plates being removably mounted in one of said recesses extending in said housing, a perimeter edge of each of said plates having a beveled upper part and a notched lower part, said notched lower part of said perimeter edge of said plates is engagable with an outer edge of said recesses such that said beveled upper part of said perimeter edge of said plates rests on and extends away from said housing, a first of said plates being removably mounted on said back side of said housing, said first of said plates having a generally trapezoidal shape, a second and third of said plates being removably mounted on said front side of said housing, said second of said plates having a generally circular shape, said third of said plates having a generally rectangular shape, said second of said plates being mounted generally adjacent to said third of said plates;

indicia being marked on said upper surface of each of said plates, wherein said indicia marked on said first of said plates identifies the cremated remains in said housing, wherein said indicia marked on said second of said plates has a shape resembling an animal, wherein said indicia marked on said third of said plates comprising a verse;

a plurality of fastening members for removably fastening each of said plates on said housing, an end of each of said fastening members extending through said plates and being removably mounted in said housing, each of said fastening members comprising a screw; and wherein a head portion of each of said fastening members is substantially flush with said upper surface of said plates when said fastening members are fully received by said housing.

* * * * *